United States Patent [19]

Pavlick

[11] Patent Number: 4,633,786

[45] Date of Patent: Jan. 6, 1987

[54] FLEXIBLE TRANSOM CONNECTED BETWEEN SIDE FRAMES OF A RAILWAY TRUCK TO PROVIDE EQUALIZATION

[75] Inventor: Michael J. Pavlick, Norristown, Pa.

[73] Assignee: The Budd Company, Troy, Mich.

[21] Appl. No.: 697,801

[22] Filed: Feb. 4, 1985

[51] Int. Cl.[4] ..... B61F 5/52

[52] U.S. Cl. ..... 105/203; 105/208

[58] Field of Search ..... 105/182 R, 208, 208.1, 105/202, 203

[56] References Cited

U.S. PATENT DOCUMENTS

| | | | |
|---|---|---|---|
| 694,492 | 3/1904 | Otis | 105/208 |
| 1,029,869 | 6/1912 | Howard et al. | 105/208 X |
| 1,994,304 | 3/1935 | Devlin | 105/208 X |
| 2,877,720 | 3/1959 | Harley et al. | 105/208 X |
| 2,928,358 | 3/1960 | Meyer | 105/208 |
| 4,030,424 | 6/1977 | Garner et al. | 105/208 X |
| 4,279,202 | 7/1981 | Dieling et al. | 105/208 X |

*Primary Examiner*—Robert B. Reeves
*Assistant Examiner*—David F. Hubbuch
*Attorney, Agent, or Firm*—Edward M. Farrell; Herman Foster; T. I. Davenport

[57] ABSTRACT

A transom, shaped in the form of an "I" beam, is welded between two side frames of a railway car. The web plate permits a small amount of twisting and relative weaving movements between the side frames in vertical directions to provide equalization.

1 Claim, 6 Drawing Figures

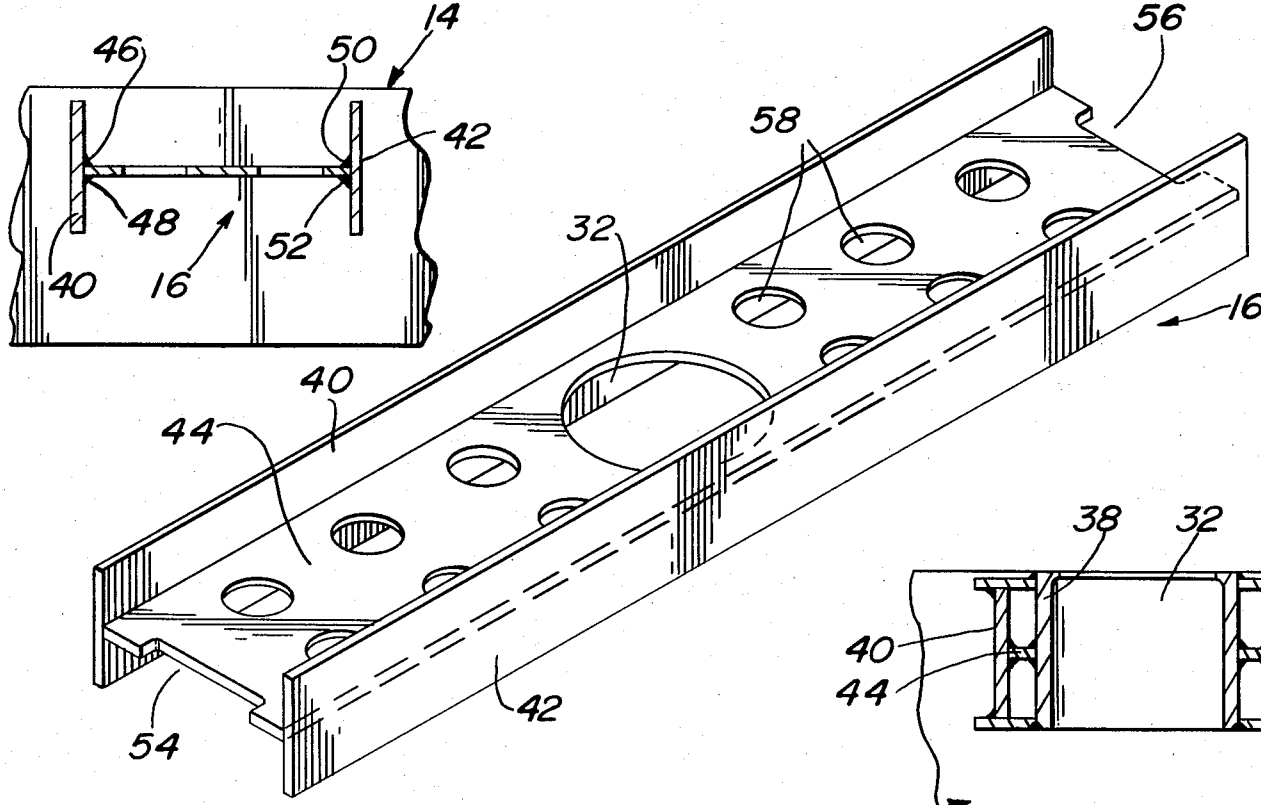
FIG. 4
FIG. 5
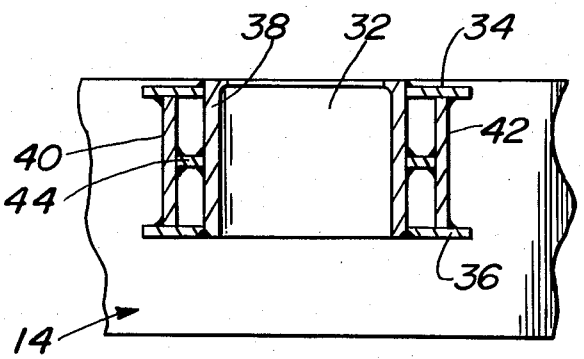
FIG. 6

FLEXIBLE TRANSOM CONNECTED BETWEEN SIDE FRAMES OF A RAILWAY TRUCK TO PROVIDE EQUALIZATION

BACKGROUND OF THE INVENTION

The use of transoms and bolsters between side frames in railway car trucks is well known. In the main, such transoms have been stiff closed structures, such as tubular members, used to prevent relative movement between the side frames which they connect, thereby providing rigid truck frames.

Some patents disclosing "I" beam or similar type structures in railway car trucks include U.S. Pat. Nos. 792,482; 942,048; 1,962,893; 1,952,819; and 2,908,230. These patents do not include structures designed for slight twisting to permit weaving of side frames in a railway truck.

It is desirable in fixed truck frames to provide equalization. Equalization requirements assure that a wheel of a truck does not lose contact with the rail when the car is traveling over an uneven track, since one wheel leaving the track could cause derailment.

OBJECTS OF THE INVENTION

It is an object of this invention to provide an improved railway truck.

It is a further object of this invention to provide an improved fixed frame truck in which limited vertical weaving is permitted in the side frames to provide equalization.

BRIEF SUMMARY OF THE INVENTION

In accordance with the present invention, a transom, shaped in the form of an "I" beam is welded between two side frames of a railway truck. A slight twisting of the transom is permitted during operation. The slight twisting permits limited weaving of the side frames to provide equalization.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIG. 4 is an isometric view of a transom, in accordance with the present invention;

FIG. 5 is a cross-sectional view taken along lines 5—5 of FIG. 2; and FIG. 6 is a cross-sectional view taken along lines 6—6 of FIG. 2.

DESCRIPTION OF THE INVENTION

Figure 1:
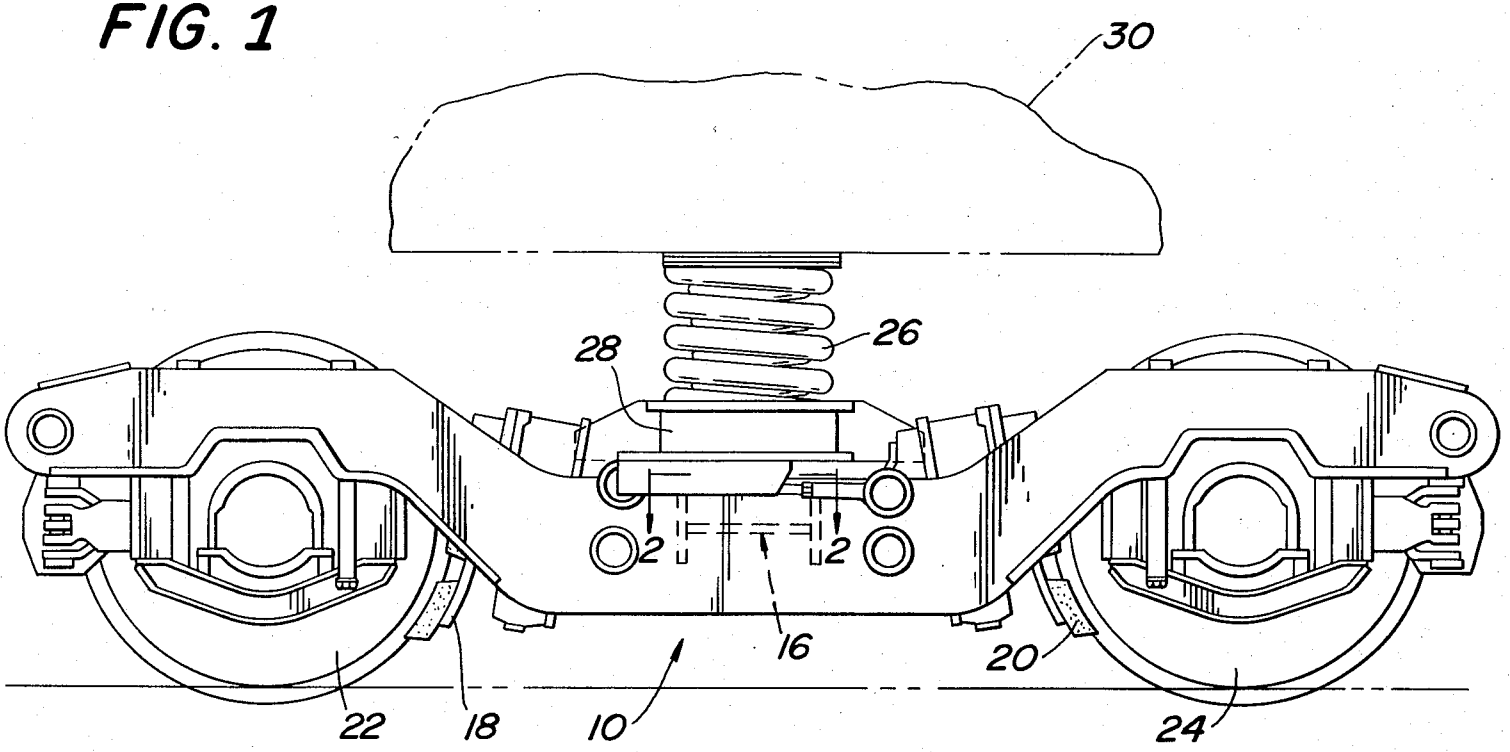
FIG. 1 is a side view of a railway truck in which the present invention may be used.
Figure 2:
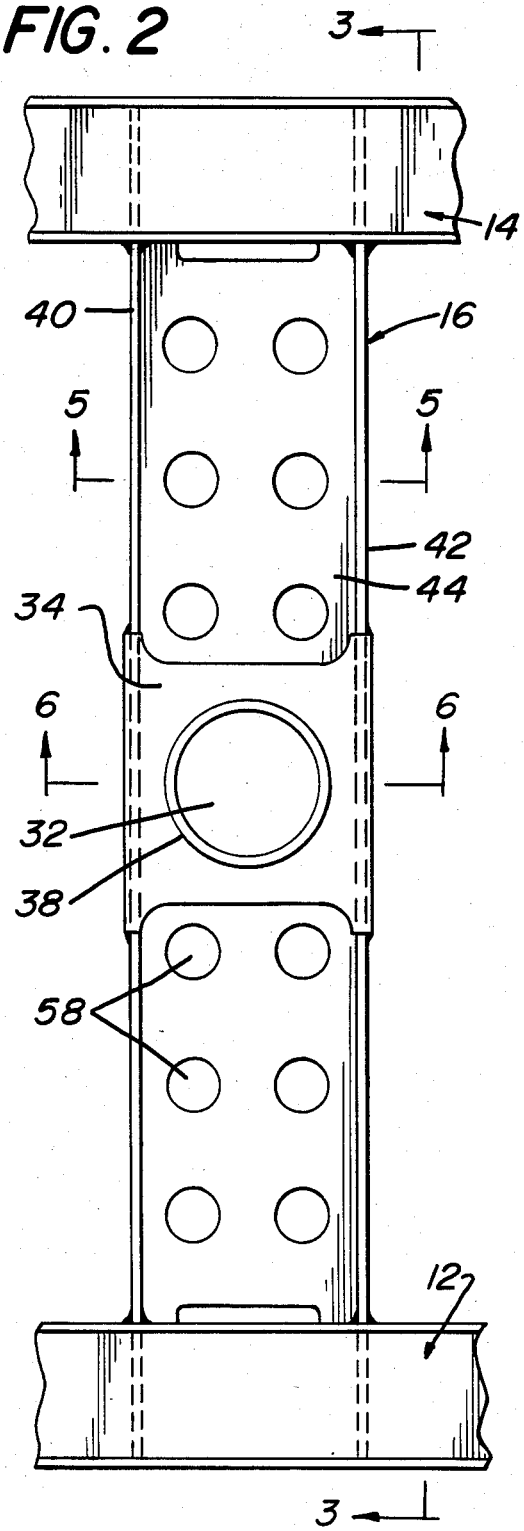
FIG. 2 is a view, taken along lines 2—2 of FIG. 1.
Figure 3:
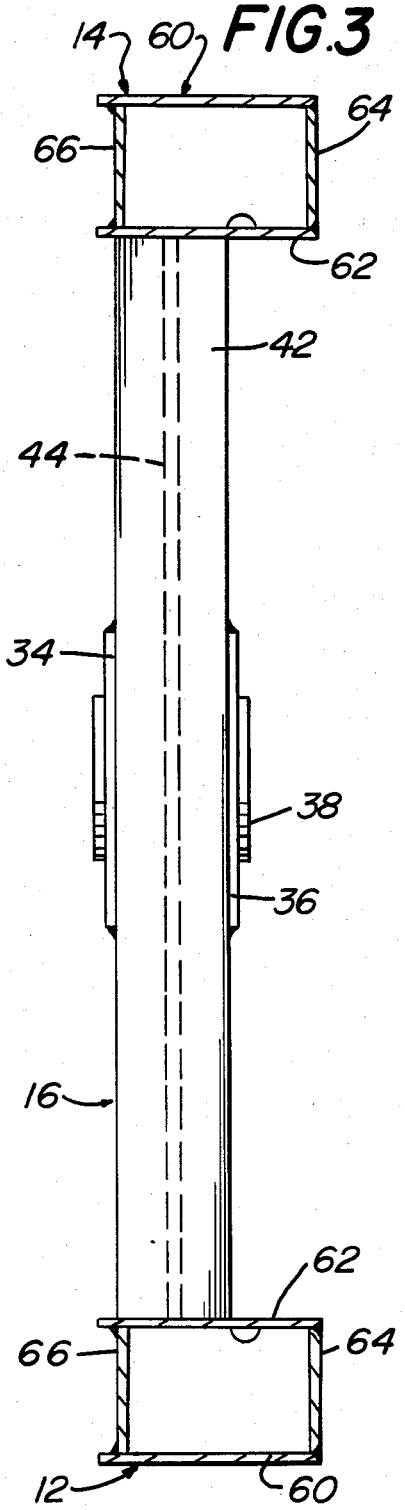
FIG. 3 is a view, taken along lines 3—3 of FIG. 2.

Referring to FIGS. 1, 2 and 3, a fixed frame truck 10 includes a pair of side frames 12 and 14 connected together by a transom 16. A pair of tread brakes 18 and 20 are mounted to the truck 10 in a conventional manner and are disposed to selectively engage wheels 22 and 24 during a braking operation. An air spring 26 rests on a bolster 28 to support a car body 30. A number of other members are secured to the truck 10 in a conventional manner. Because these members are known to those skilled in the art and because they are not directly related to the present invention, they will not be described in detail.

The present invention is directed towards the transom 16 which connects the side frames 12 and 14.

Referring to FIGS. 4 and 5, along with FIGS. 2 and 3, only the side frame 12 and transom 16 and their associated parts will be described in detail. It is understood that the description of side frame 12 also applies to the side frame 14.

The transom 16 includes a large center opening 32 for receiving a king pin connector from the car body 30. Members including a top plate 34, a bottom plate 36 and a tubular member 38 are centrally welded to the transom 16 in a manner illustrated in FIG. 6.

The transom 16 comprises a pair of side plates 40 and 42 welded to a web plate 44. Separate pieces are used to form the "I" beam shaped transom 16 because it is easier to control the precise thicknesses of the plates to control the small resiliency which is designed into the transom. FIG. 5 illustrates the side plate 40 welded to the web plate 44 by welds 46, 48 and the side plate 42 welded to the web plate 44 by welds 50, 52.

The transom 16 includes cut-away end portions 54 and 56. The transom 16 alone includes a plurality of circular openings 58 which extend along the length of the web plate 44. These openings 58 provide water drainage.

The side frame 12 is made of four welded plates 60, 62, 64 and 66. The side frame 14 comprises similar plates.

The side plates 40 and 42 provide a certain amount of rigidity between the side frames 12 and 14 because they are welded directly thereto. The web plate 44, however, being an open structure, is capable of being twisted a small amount. The end cut-away portions 54 and 56 which leave portions of the web plate 44 free of the side frames 12 and 14. The cut-away portions 54, 56 and openings 58 provide additional resiliency in the web plate 42 and may be used to control to some extent the amount of resiliency in the final transom.

The slight resiliency in the web plate 44 permits small weaving of the side frames 12 and 14 in vertical directions. The small weaving motions permit the wheels of the truck to move vertically to accommodate small bumps or irregularities in the track thus providing equalization. At the same time, a basically rigid truck frame is provided.

What is claimed is:

1. In combination with a railway car truck having a pair of side frames including four joined welded plates for receiving wheel axle units, an integral transom connecting said side frames comprising:

(a) a pair of side plates and a web plate welded together to form an open "I" beam structure having a constant cross section throughout its length;

(b) said web plate including end sections having cut-away portions therein;

(c) means for welding said "I" beam structure to said side frames whereby relatively small twisting movements of said web plate permits small weaving movements between said side frames in vertical directions to provide equalization in said truck;

(d) said transom including plurality of openings included therein to provide water drainage;

(e) said transom further including a relatively large central opening to receive therein a connecting member of said rail car; and (f) said side plates being vertically disposed and said web plate being horizontally disposed.

* * * * *